US005667843A

United States Patent [19]

Yoshitake et al.

[11] Patent Number: 5,667,843

[45] Date of Patent: Sep. 16, 1997

[54] PRE-TREATING ZINCIFEROUS SURFACES BEFORE CONVENTIONAL CHROMATING TO IMPROVE RUST RESISTANCE

[75] Inventors: Noriaki Yoshitake; Kensuke Mizuno; Takao Ogino, all of Kanagawa-ken, Japan

[73] Assignee: Henkel Corporation, Plymouth Meeting, Pa.

[21] Appl. No.: 965,643

[22] Filed: Oct. 23, 1992

[30] Foreign Application Priority Data

Oct. 24, 1991 [JP] Japan ..... 3-303857

[51] Int. Cl.[6] ..... B05D 3/04; C23C 22/24

[52] U.S. Cl. ..... 427/305; 427/318; 427/328; 427/405; 427/436; 148/267; 148/268

[58] Field of Search ..... 427/305, 328, 427/405, 436, 318; 148/267, 268

[56] References Cited

U.S. PATENT DOCUMENTS

| | | | |
|---|---|---|---|
| 3,514,343 | 5/1970 | Bauman | 148/267 |
| 3,954,510 | 5/1976 | Gunn et al. | 148/268 |
| 3,990,920 | 11/1976 | De Ridder et al. | 148/268 |
| 4,801,337 | 1/1989 | Higgins | 148/267 |
| 4,840,820 | 6/1989 | Schuitz et al. | 427/405 |
| 5,091,223 | 2/1992 | Mori et al. | 427/436 |

FOREIGN PATENT DOCUMENTS

| | | |
|---|---|---|
| 59-177381 | 10/1984 | Japan . |
| 2275837 | 10/1990 | Japan . |

*Primary Examiner*—Shrive Beck
*Assistant Examiner*—Brian K. Talbot
*Attorney, Agent, or Firm*—Ernest G. Szoke; Wayne C. Jaeschke; Norvell E. Wisdom, Jr.

[57] ABSTRACT

The protection against black and white rust on zinciferous surfaces by a conventional chromating treatment is improved by drying into place on the zinciferous surface before chromating a pre-treatment composition that contains hexavalent chromium ion plus one or more salts of nickel and cobalt, in an amount to produce an add-on of 0.5 to 100 $mg/m^2$ of metal.

8 Claims, No Drawings

PRE-TREATING ZINCIFEROUS SURFACES BEFORE CONVENTIONAL CHROMATING TO IMPROVE RUST RESISTANCE

BACKGROUND OF THE INVENTION

1. Field of the Invention

The present invention relates to a method for treating a zinciferous metal surface, i.e., one with a surface composition that is at least 45% zinc by weight. The method is particularly suitable for treating zinc-plated steel sheet and will be generally so described herein below, but treatment of other zinciferous surfaces is within the broadest scope of the invention. More specifically, the present invention relates to a treatment of the zinciferous surface before applying a conventional chromating treatment; the pretreatment of this invention increases the resistance of the later applied chromate film to the development of black and/or white types of rust on the zinciferous surface. The invention is particularly suited to treating electrogalvanized steel sheet and hot-dip galvanized steel sheet.

2. Statement of Related Art

The sacrificial corrosion protection of iron and steel using zinc plating has proven to be the most effective and economical, with the result that 10% of Japan's annual raw steel output of 100 million tons—or 10 million tons—is produced as zinc-plated steel sheet. This zinc-plated steel sheet is used in a number of fields, e.g., as a building material, for automobiles, and in household electrical appliances.

In sacrificial corrosion protection by zinc, the two metals, zinc and iron (or steel), form a cell when brought into contact. As the baser metal, zinc becomes the anode, thus cathodizing the iron and suppressing the anodic dissolution caused by the formation of local cells in the case of iron alone. This results in an inhibition of the corrosion of the iron or steel. Accordingly, the anticorrosive action ceases when the zinc in contact with the iron or steel has been consumed, and this fact requires that corrosion of the zinc layer itself be inhibited if it is to exercise long-term activity. Chromating is conducted after plating as a countermeasure to zinc corrosion.

However, chromating-based rust prevention suffers from the following deficiency: While the chromating of zinc plated steel sheet does result in a substantial inhibition of white rust development, the development of black rust (known as blackening) still occurs during storage and transport. This black rust impairs the external appearance. It has been observed that this blackening phenomenon occurs more readily for steel sheet subjected to a post galvanization skin pass and for steel sheet plated with a Zn/Al alloy containing several % Al than in the case of ordinary zinc-plated steel sheet.

Flash treatment, by $Ni^{2+}$ and/or $Co^{2+}$ containing aqueous solution for example, as described in Japanese Patent Application Laid Open [Kokai] Number 59-177381 [177,381/1984], is currently regarded as a powerful countermeasure for solving this post-chromating black rust problem. (Here and below, flash treatment is taken to mean the chemical deposition of very small quantities of metal.)

In its essential features, the above-referenced invention concerns a means for inhibiting black rust through the pre-chromating flash treatment of the surface of zinc plated or zinc alloy plated steel sheet. In this particular flash treatment, the surface of the steel sheet is flash treated with an aqueous solution (pH 1 to 4 or 11 to 13.5) that contains the $Ni^{2+}$ and/or $Co^{2+}$ metal ion(s). This treatment results in the deposition of these metal ions on the plating surface as the metal or oxide. This treatment is followed by a water wash and then by the formation of a chromate film.

The mechanism has yet to be clearly established for black rust inhibition on zinc-plated or zinc alloy-plated steel sheet that has been Ni and/or Co flash-treated and subsequently chromated. However, according to the report on pages 150 to 151 of Abstracts of the 60th Scientific Lecture Conference of *Kinzoku Hyomen Gijutsu Kyokai* [Metal Finishing Society of Japan], the flashed metal is largely deposited at the zinc crystal grain boundaries. It is further reported that the chromium compounds laid down in a follow-on application-type chromating treatment are, like the flashed metal, also distributed at the grain boundaries. Presumably there is some type of interaction between the flashed metal and the chromium compounds, and the chromium compounds are thereby adsorbed and fixed on the flashed metal.

Zinc black rust, like the corresponding white rust, is thought to be a basic zinc carbonate $(ZnCO_3)_x[Zn(OH)_2]_y$; however, it differs from white rust in that it is oxygen deficient on a stoichiometric basis. Black rust is therefore a corrosion product occurring under oxygen-deficient conditions, and in particular it is thought that black rust is formed in association with the development of corrosion from the grain boundaries. As a result, it can be postulated that the chromium compounds concentrated at the grain boundaries by the flashed metal contribute to an inhibition of black rust development by inhibiting corrosion originating from the grain boundaries.

As stated above, the Ni and/or Co flash-treatment of zinc-plated steel sheet prior to its chromating is in fact a powerful countermeasure against the problem of black rust. However, this flash treatment prior to chromating is deficient in that it permits the rather facile development of white rust despite its inhibition of black rust.

One pre-chromating treatment that improves the blackening resistance, corrosion resistance, post-painting corrosion resistance, and paint adherence and that does so while maintaining a good balance among these properties is disclosed in Japanese Patent Application Number Hei 2-275 837 [275,837/1990], filed 15 Oct. 1990. In this method, an aqueous solution of one or more selections from the sulfate and phosphate salts of $Ni^{2+}$ and $Co^{2+}$ is applied to the zinc or zinc alloy surface prior to chromating. Drying then affords a film at a loading of 0.5 to 100 $mg/m^2$. While this method does achieve its intended effects, zinc elutes from the plating surface due to reaction with the sulfate in the treatment bath. As a result, when the treatment bath is recycled, a zinc reaction precipitate gradually accumulates in the bath. This makes the bath unstable, that is, its performance gradually deteriorates.

One prior-art pre-treatment method consists of a water wash subsequent to the substitutional plating of $Ni^{2+}$ and $Co^{2+}$ in an alkaline bath that contains a complexing agent such as ammonia, organic acid, and the like. However, in this pre-treatment method, almost all of the Ni and Co retained on the treated surface is believed to be precipitated as metal. Thus, while this pre-treatment method does in fact improve the black rust resistance and paint adherence, local cells can be formed with the Zn and this results in a strong microcorrosion tendency and a deterioration in resistance to white rusting.

DESCRIPTION OF THE INVENTION

In this description, except in the claims and the specific examples or where expressly indicated to the contrary, all numbers specifying amounts of materials or conditions of reaction or use are to be understood as modified by the term "about" in determining the broadest scope of the invention. Practice of the invention within the exact numerical limits given is generally preferred.

SUMMARY OF THE INVENTION

In order to overcome the deficiencies in the prior art as discussed hereinbefore, diverse research was conducted into methods for inhibiting white rust and black rust on electrogalvanized steel sheet, which is particularly vulnerable to the above-mentioned deficiencies. As a result, it has been discovered that black rust development can be inhibited without impairing the anti-white rust performance when a particular pre-treatment method is used on zinc-plated steel sheet, followed by a conventional chromate rust-prevention treatment, and that the treatment bath can be used on a continuous basis. Said pre-treatment method comprises the formation of a 0.5 to 100 milligrams per square meter (hereinafter "mg/m$^2$"), or preferably a 5.0 to 100 mg/m$^2$, film (as metal) on the surface of zinc-plated steel sheet, prior to conventionally chromating the same, by the application to said surface of an aqueous solution that comprises, preferably consists essentially of, or more preferably consists of, water, hexavalent chromium ions and one or more compounds of nickel and cobalt, preferably selected from the sulfates and nitrates of nickel and cobalt, optionally includes certain other ingredients as noted below, and subsequently drying.

DESCRIPTION OF PREFERRED EMBODIMENTS

The aqueous solution (pre-treatment bath) used by the present invention must contain hexavalent chromium ion and one or both of the nickel and cobalt metal ions. It is also preferable that sulfates and nitrates be used to supply these metal ions to the treatment bath. The chlorides should be avoided because they degrade the anti-white rust performance. Zinc dissolution by the pre-treatment bath is reduced by the presence of hexavalent chromium ion in the treatment bath. A pre-treatment bath free of hexavalent chromium ion is therefore disadvantageous because the zinc plated on the steel surface is then readily dissolved when zinc-plated steel sheet is brought into contact with the bath. Not only does this degrade the corrosion resistance, but the dissolved zinc ion accumulates in the pre-treatment bath and impairs the stability of the bath. Dichromic acid and the alkali metal and ammonium salts of dichromic acid can be used as source compounds for the hexavalent chromium ion.

In order to stabilize the pre-treatment bath, it may optionally, and usually preferably, contain complexing agents such as gluconic acid, heptogluconic acid, and salts thereof such as sodium gluconate and sodium heptogluconate. The bath may also contain lead salts, preferably, if used at all, in a molar concentration not greater than the total of the nickel and cobalt concentrations in the bath.

With regard to the pre-treatment technique, this comprises application of the pre-treatment bath to the zinc plating by known application techniques such as spray, immersion followed by a roll squeegee operation, immersion followed by an air knife squeegee, roll coating, and the like. After application and adherence of the pre-treatment bath in such a manner, drying is then conducted without an intervening water wash.

Although no specific restrictions obtain on the drying conditions, drying should be run under conditions at which the water content in the coated film is evaporated, and drying is generally run at sheet temperatures of 40° C. to 100° C.

The film weight applied to the surface of electrogalvanized steel sheet or hot-dip galvanized steel sheet by treatment in accordance with the present invention should fall within the range of 0.5, or preferably 5.0, to 100 mg/m$^2$, measured as metal. No anti-blackening activity appears at less than 0.5 mg/m$^2$, while exceeding 100 mg/m$^2$ does not produce any further improvement in black rust inhibition activity and is economically disadvantageous.

The present invention includes a drying step subsequent to the application of an aqueous solution that contains hexavalent chromium ion and one or more nickel and cobalt compounds, preferably selected from the sulfates and nitrates of nickel and cobalt.

Other divalent metal ions than cobalt and nickel, such as $Mn^{2+}$, $Sn^{2+}$, and $Cu^{2+}$, do not have the ability to inhibit black rust. If chlorides of cobalt and nickel are used, the $Cl^-$ ion remaining on the zinc surface promotes the development of white rust.

Preferred modes of using the present invention are described in greater detail below using illustrative examples; however, these examples do not limit the present invention and are provided merely in order to explain the present invention.

EXAMPLES

Experiment Group 1

Sample test sheets of oiled electrogalvanized steel with 20 g/m$^2$ of zinc were subjected to an alkaline degreasing, water wash, and drying in accordance with the process sequence shown below in all of the examples and comparison examples. In Examples 1–5 and Comparison Examples 1–4, the sample test sheet was then subjected to a pre-treatment in accordance with steps (4) and (5), using the particular treatment bath reported in Table 1. Each pre-treated sample test sheet and a sample test sheet that had not been pre-treated (Comparison Example 5) were subjected to the chromating treatment described in item (6) in the process sequence. After these treatments, all sample test sheets were subjected to the black rust acceleration test and white rust acceleration test described below. The treatment baths were also subjected to stability testing.

TABLE 1

RESULTS WITH ELECTROGALVANIZIED STEEL WORKPIECES

| No. | Ingredient and Molar Concentration in Pre-Treatment Bath | Film Mass mg/m$^2$ | Rating from Test for: BR | WR | BS |
|---|---|---|---|---|---|
| Ex 1 | 0.01 $NiSO_4$<br>0.001 $K_2Cr_2O_7$ | 1.8 | 5 | 5 | ++ |
| Ex 2 | 0.10 $Co(NO_3)_2$<br>0.0005 $CrO_3$<br>0.0008 $(NH_4)_2Cr_2O_7$ | 17.7 | 5 | 5 | ++ |
| Ex 3 | 0.08 $CoSO_4$<br>0.20 $NiSO_4$<br>0. 005 $(NH_4)_2Cr_2O_7$ | 49.4 | 5 | 5 | ++ |
| Ex 4 | 0.03 $NiSO_4$<br>0.06 heptogluconic acid<br>0.003 $K_2Cp_2O_7$ | 5.3 | 5 | 5 | ++ |
| Ex 5 | 0.03 $NiSO_4$<br>0.10 $Co(NO_3)_2$<br>0.001 $(NH_4)_2Cr_2O_7$ | 23.2 | 5 | 5 | ++ |
| CE 1 | 0.05 $NiCl_5$ | 5.8 | 4 | 1 | x |

TABLE 1-continued

RESULTS WITH ELECTROGALVANIZIED STEEL WORKPIECES

| No. | Ingredient and Molar Concentration in Pre-Treatment Bath | Film Mass mg/m² | Rating from Test for: BR | WR | BS |
|---|---|---|---|---|---|
| CE 2 | 0.02 $Co(NO_3)_2$ | 3.5 | 2 | 4 | x |
| CE 3 | 0.09 $CoSO_4$<br>0.06 heptogluconic acid | 15.9 | 5 | 5 | + |
| CE 4 | See Note 1 | 2.2 | 5 | 2 | – |
| CE 5 | No pre-treatment | — | 1 | 5 | – |

Numbered Note for TABLE 1

1. This pre-treatment was according to Example 1-d of Japanese Laid-Open Application No. 59-177381 with tap water wash after cobalt treatment. The film mass reported in this particular Comparative Example is for cobalt.

Other Notes for TABLE 1

"Ex" = Example; "CE" = Comparison Example; "BR" = black rust; "WR" = white rust; "BS" = bath stability. The film masses reported are for the amount of metal deposited during the combined pre-treatment and drying after pre-treatment steps (steps (4) and (5) in the process sequence given in the main text).

The process sequence included the following steps:

(1) Alkaline degreasing with a weakly alkaline degreaser (PALKLIN™ 342 from Nihon Parkerizing Company, Limited, 2% aqueous solution, 60° C., 30 second spray).

(2) Wash by 10 second spray with tap water.

(3) Blow drying.

(4) Pre-treatment: The aqueous solution reported in Table 1 was applied by roll coating at a wet coating add-on level of 3 mL/m².

(5) Drying for 2 seconds with a maximum attained sheet temperature of 50° C.

(6) Chromating treatment with a dispersion of colloidal silica in aqueous chromic acid solution having a trivalent/hexavalent chromium weight ratio ($Cr^{3+}/Cr^{6+}$) of 0.5; a $CrO_3$:$SiO_2$ weight ratio of 1:2, based on the stoichiometric equivalent as $CrO_3$ of all the chromium in the composition; and a total chromium ($Cr^{3+}+Cr^{6+}$) concentration of 1%; application was by roll coating to give a chromium add-on of 45 to 50 mg/m² as chromium metal.

(8) Drying for 5 seconds with a maximum attained sheet temperature of 80° C.

Black Rust Acceleration Test

Multiple 70×150 mm test coupons were cut from the particular test sample sheet. The test surface of a test coupon was overlaid on the test surface of another coupon to give a pair. 5–10 pairs were stacked and the stack was wrapped in vinyl sheet. The four corners were clamped with bolts, and a load of 0.67 kgf-cm was applied by tightening with a torque wrench. The assembly was held in a humid chamber at 70° C. and 80% relative humidity for 240 hours. Blackening on the stacked regions was then visually inspected.

The following evaluation criteria were used:

5=no blackening

4=very slight greying

3=<25% blackening

2=≧25% to <50% blackening

1=≧50% blackening.

White Rust Acceleration Test

A 70×150 mm test coupon was cut from the particular sample test sheet and subjected to salt-spray testing in accordance with JIS Z 2371. The area of white rust development was visually inspected after 120 hours and reported according to the following evaluation criteria:

5=no white rust

4=<5% area of white rust development

3=5 to <25% area of white rust development

2=25 to <50% area of white rust development

1=≧50% area of white rust development.

Treatment Bath Stability Testing

Five sheets of electrogalvanized steel (sheet size=7×15 cm), degreased in accordance with steps (1) and (2) above, were immersed for 24 hours at ambient temperature in a treatment bath with the composition reported in Table 1. The development of precipitate was then visually evaluated using the following evaluation criteria:

++=no production of precipitate

+=moderate production of precipitate x=more than moderate production of precipitate.

Table 1 reports the treatment bath compositions, film weights, and the results of black rust acceleration testing, white rust acceleration testing, and treatment bath stability testing for Experiment Group 1. As Examples 1 to 5 make clear, the present invention introduces a pre-treatment method for electrogalvanized steel sheet that improves the resistance to blackening and the resistance to white rust while keeping these properties in good balance. In addition, an excellent bath stability is obtained through the addition of hexavalent chromium ion. In contrast to this, the method in Comparison Example 1, while effective in black rust prevention, is compromised by its poor white rust resistance and poor treatment bath stability. Comparison Example 2 is ineffective in the category of black rust prevention. The method of Comparison Example 3 is effective in black rust prevention and white rust prevention, but it suffers from an inferior treatment bath stability. Comparison Example 4 is effective for black rust prevention, but is ineffective with regards to white rust prevention, while Comparison Example 5 is totally ineffective for black rust prevention.

Experiment Group 2

Hot-dip galvanized steel sheet was pre-treated, chromated, and tested in accordance with the methods described for Experiment Group 1 above. Two types of hot-dip galvanized steel sheet were used, one with Zn containing 5% Al and the other with an alloy of 45% Zn and 55% Al. The results, which were substantially the same for both types of sample test sheets, are reported in Table 2 (for workpieces pre-treated with a wet coating rate=2 mL/m²), Table 3 (for workpieces pre-treated with a wet coating rate=3 mL/m²), and Table 4 (for workpieces with a wet coating rate=3.5 mL/m²).

TABLE 2

RESULTS WITH HOT-DIP GALVANIZED STEEL WORKPIECES

| No. | Ingredient and Molar Concentration in Pre-Treatment Bath | Film Mass mg/m² | Rating from Test for: BR | WR | BS |
|---|---|---|---|---|---|
| Ex 1 | 0.13 $CoSO_4$<br>0.03 $Pb(NO_3)_2$<br>0.001 $(NH_4)_2Cr_2O_7$ | 27.5 | 5 | 5 | ++ |
| Ex 2 | 0.10 $Co(NO_3)_2$<br>0.0005 $CrO_3$<br>0.0008 $(NH_4)_2Cr_2O_7$ | 12.1 | 5 | 5 | ++ |

TABLE 2-continued

RESULTS WITH HOT-DIP GALVANIZED STEEL WORKPIECES

| No. | Ingredient and Molar Concentration in Pre-Treatment Bath | Film Mass mg/m² | Rating from Test for: BR | WR | BS |
|---|---|---|---|---|---|
| Ex 3 | 0.03 $NiSO_4$<br>0.06 heptogluconic acid<br>0.0003 $K_2Cr_2O_7$ | 3.6 | 5 | 5 | ++ |
| CE 1 | 0.05 $NiCl_2$ | 5.8 | 4 | 1 | x |
| CE 2 | 0.03 $Ni(NO_3)_2$ | 3.6 | 5 | 5 | x |
| CE 3 | 0.12 $CoSO_4$<br>0.06 heptogluconic acid | 14.5 | 3 | 1 | + |
| CE 4 | See Note 1 | 2.2 | 5 | 2 | – |
| CE 5 | No pre-treatment | — | 1 | 5 | – |
| CE 6 | 0.08 $Fe(NO_3)_3$<br>0.03 $CoSO_4$ | 12.9 | 5 | 5 | x |
| CE 7 | 0.20 $NiSO_4$<br>0.30 gluconic acid<br>0.08 $Fe_2(SO_4)_3$ | 42.9 | 5 | 5 | + |
| CE 8 | 0.01 $Ni(NO_3)_2$<br>0.20 heptogluconic acid<br>0.13 $Pb(NO_3)_2$ | 54.8 | 5 | 5 | + |

Numbered Note for TABLE 2

1. This pre-treatment was according to Example 1-d of Japanese Laid-Open Application No. 59-177381 with tap water wash after cobalt treatment. The film mass reported in this particular Comparative Example is for cobalt.

Other Notes for TABLE 2

"Ex" = Example; "CE" = Comparison Example; "BR" = black rust; "WR" = white rust; "BS" = bath stability. The film masses reported are for the amount of metal deposited during the combined pre-treatment and drying after pre-treatment steps (steps (4) and (5) in the process sequence given in the main text).

TABLE 3

RESULTS WITH HOT-DIP GALVANIZED STEEL WORKPIECES

| No. | Ingredient and Molar Concentration in Pre-Treatment Bath | Film Mass mg/m² | Rating from Test for: BR | WR | BS |
|---|---|---|---|---|---|
| Ex 4 | 0.13 $CoSO_4$<br>0.03 $Pb(NO_3)_2$<br>0.001 $(NH_4)_2Cr_2O_7$ | 41.3 | 5 | 5 | ++ |
| Ex 5 | 0.10 $Co(NO_3)_2$<br>0.0005 $CrO_3$<br>0.0008 $(NH_4)_2Cr_2O_7$ | 18.0 | 5 | 5 | ++ |
| Ex 6 | 0.03 $NiSO_4$<br>0.06 heptogluconic acid<br>0.0003 $K_2Cr_2O_7$ | 5.6 | 5 | 5 | ++ |
| CE 9 | 0.05 $NiCl_2$ | 8.9 | 4 | 1 | x |
| CE 10 | 0.03 $Ni(NO_3)_2$ | 5.5 | 5 | 5 | x |
| CE 11 | 0.12 $CoCl_2$<br>0.06 heptogluconic acid | 22.1 | 2 | 1 | + |
| CE 12 | See Note 1 | 2.1 | 5 | 2 | – |
| CE 13 | No pre-treatment | — | 1 | 4 | – |
| CE 14 | 0.08 $Fe(NO_3)_3$<br>0.03 $CoSO_4$ | 20.1 | 5 | 5 | x |
| CE 15 | 0.20 $NiSO_4$<br>0.30 gluconic acid<br>0.08 $Fe_2(SO_4)_3$ | 64.3 | 5 | 5 | + |
| CE 16 | 0.01 $Ni(NO_3)_2$<br>0.20 heptogluconic acid<br>0.13 $Pb(NO_3)_2$ | 82.8 | 5 | 5 | + |

Numbered Note for TABLE 3

1. This pre-treatment was according to Example 1-d of Japanese Laid-Open Application No. 59-177381 with tap water wash after cobalt treatment. The film mass reported in this particular Comparative Example is for cobalt.

Other Notes for TABLE 3

TABLE 3-continued

RESULTS WITH HOT-DIP GALVANIZED STEEL WORKPIECES

| No. | Ingredient and Molar Concentration in Pre-Treatment Bath | Film Mass mg/m² | Rating from Test for: BR | WR | BS |
|---|---|---|---|---|---|

"Ex" = Example; "CE" = Comparison Example; "BR" = black rust; "WR" = white rust; "BS" = bath stability. The film masses reported are for the amount of metal deposited during the combined pre-treatment and drying after pre-treatment steps (steps (4) and (5) in the process sequence given in the main text).

TABLE 4

RESULTS WITH HOT-DIP GALVANIZED STEEL WORKPIECES

| No. | Ingredient and Molar Concentration in Pre-Treatment Bath | Film Mass mg/m² | Rating from Test for: BR | WR | BS |
|---|---|---|---|---|---|
| Ex 7 | 0.13 $CoSO_4$<br>0.03 $Pb(NO_3)_2$<br>0.001 $(NH_4)_2Cr_2O_7$ | 48.3 | 5 | 5 | ++ |
| Ex 8 | 0.10 $Co(NO_3)_2$<br>0.0005 $CrO_3$<br>0.0008 $(NH_4)_2Cr_2O_7$ | 21.2 | 5 | 5 | ++ |
| Ex 9 | 0.03 $NiSO_4$<br>0.06 heptogluconic acid<br>0.0003 $K_2Cr_2O_7$ | 6.4 | 5 | 5 | ++ |
| Ex 10 | 0.08 $Fe(NO_3)_3$ | 22.8 | 5 | 5 | ++ |
| CE 17 | 0.05 $NiCl_2$ | 10.1 | 4 | 1 | x |
| CE 18 | 0.03 $Ni(NO_3)_2$ | 6.4 | 5 | 5 | x |
| CE 19 | 0.12 $CoCl_4$<br>0.06 heptogluconic acid | 25.5 | 2 | 1 | + |
| CE 20 | See Note 1 | 2.2 | 5 | 2 | – |
| CE 21 | No pre-treatment | — | 1 | 4 | – |
| CE 22 | 0.08 $Fe(NO_3)_3$<br>0.03 $CoSO_4$ | 22.8 | 5 | 5 | x |
| CE 23 | 0.20 $NiSO_4$<br>0.30 gluconic acid<br>0.08 $Fe_2(SO_4)_3$ | 75.0 | 5 | 5 | + |
| CE 24 | 0.01 $Ni(NO_3)_2$<br>0.20 heptogluconic acid<br>0.13 $Pb(NO_3)_2$ | 95.6 | 5 | 5 | + |

Numbered Note for TABLE 4

1. This pre-treatment was according to Example 1-d of Japanese Laid-Open Application No. 59-177381 with tap water wash after cobalt treatment. The film mass reported in this particular Comparison Example is for cobalt.

Other Notes for TABLE 4

"Ex" = Example; "CE" = Comparison Example; "BR" = black rust; "WR" = white rust; "BS" = bath stability. The film masses reported are for the amount of metal deposited during the combined pre-treatment and drying after pre-treatment steps (steps (4) and (5) in the process sequence given in the main text).

As Examples 1 to 10 in Experiment Group 2 make clear, the present invention introduces a pre-treatment method for hot-dip galvanized steel sheet that improves the resistance to blackening and the resistance to white rust after subsequent conventional chromating treatment, while keeping these properties in good balance. In addition, an excellent bath stability is obtained through the use of hexavalent chromium ion. In contrast to this, the methods in Comparison Examples 1, 3, 4, 5, 9, 11, 12, 17, 19, and 20 in Experiment Group 2, while at least moderately effective in black rust prevention, are compromised by their poor white rust resistance and indaequate treatment bath stability. Comparison Examples 3, 5, 11, 13, 19, and 21 are inadequate in black rust prevention. The methods of Comparison Examples 6–8, 14–16, and 22–24 protect adequately against both white and black rust but have less bath stability than methods according to this invention.

Benefits of the Invention

As described in detail hereinbefore, the present invention provides a very balanced improvement in the resistance to both black and white rust. Moreover, treatment bath stability is improved by the addition of hexavalent chromium ion, which makes possible recycle of the treatment bath in the continuous treatment of steel sheet. As a consequence of these effects, the efficiency is improved and the corrosion resistance against both black and white rust is stabilized, and accordingly the invention is highly qualified for industrial application.

The invention claimed is:

1. A process for treating a zinciferous surface, said process comprising steps of:

(A) coating the zinciferous surface with a film of an aqueous liquid pre-treatment composition consisting essentially of (i) water; (ii) cations selected from the group consisting of cobalt, nickel, and both cobalt and nickel; (iii) anions containing hexavalent chromium; and (iv) sufficient anions to balance the charge of the cations present and, optionally, (v) complexing agents for cobalt and nickel cations; and, optionally, (vi) divalent lead cations, trivalent iron cations, or both; said pre-treatment composition also being substantially free from chloride ions; and (B) drying into place on the zinciferous surface the film of aqueous liquid coated thereon in step (A); and (C) applying a chromate coating to the zinciferous surface as treated at the end of step (B), the amount of chromate coating thus applied being sufficient to inhibit the corrosion of the underlying zinciferous surface, the total mass of cobalt and nickel added to the zinciferous surface during steps (A) and (B) being in the range from about 0.5 to about 100 $mg/m^2$ of the zinciferous surface treated.

2. A process according to claim 1, wherein the total mass of cobalt and nickel added to the zinciferous surface is in the range from about 5.0 to about 100 $mg/m^2$.

3. A process according to claim 2, wherein the pre-treatment composition consists essentially of (i) water; (ii) cations selected from the group consisting of cobalt, nickel, and both cobalt and nickel; (iii) anions containing hexavalent chromium; and (iv) sufficient anions to balance the charge of the cations present and, (v) a complexing agent for cobalt and nickel cations selected from the group consisting of gluconic acid and its salts, heptogluconic acid and its salts, and mixtures thereof; and, optionally, (vi) divalent lead cations, trivalent iron cations, or both; said pre-treatment composition also being substantially free from chloride ions.

4. A process according to claim 1, wherein the pre-treatment composition consists essentially of (i) water; (ii) cations selected from the group consisting of cobalt, nickel, and both cobalt and nickel; (iii) anions containing hexavalent chromium; and (iv) sufficient anions to balance the charge of the cations present and, (v) a complexing agent for cobalt and nickel cations selected from the group consisting of gluconic acid and its salts, heptogluconic acid and its salts, and mixtures thereof; and, optionally, (vi) divalent lead cations, trivalent iron cations, or both; said pre-treatment composition also being substantially free from chloride ions.

5. A process according to claim 4, wherein component (iv) of the pre-treatment composition includes a total of sulfate and nitrate anions sufficient to balance the charge of its total content of cobalt and nickel cations.

6. A process according to claim 3, wherein component (iv) of the pre-treatment composition includes a total of sulfate and nitrate anions sufficient to balance the charge of its total content of cobalt and nickel cations.

7. A process according to claim 2, wherein component (iv) of the pre-treatment composition includes a total of sulfate and nitrate anions sufficient to balance the charge of its total content of cobalt and nickel cations.

8. A process according to claim 1, wherein component (iv) of the pre-treatment composition includes a total of sulfate and nitrate anions sufficient to balance the charge of its total content of cobalt and nickel cations.

* * * * *